US007077146B1

(12) United States Patent
Eckerson

(10) Patent No.: US 7,077,146 B1
(45) Date of Patent: Jul. 18, 2006

(54) HAIR ROOT COLORING SYSTEM

(76) Inventor: Judy V. Eckerson, 1324 6th Ave., Worthington, MN (US) 56187

( * ) Notice: Subject to any disclaimer, the term of this patent is extended or adjusted under 35 U.S.C. 154(b) by 448 days.

(21) Appl. No.: 10/351,635

(22) Filed: Jan. 24, 2003

(51) Int. Cl.
*A45D 24/22* (2006.01)

(52) U.S. Cl. ..... 132/113; 132/112

(58) Field of Classification Search ..... 132/111–116; 401/171, 176–181; 222/137, 145.5, 145.6
See application file for complete search history.

(56) References Cited

U.S. PATENT DOCUMENTS

| | | | | |
|---|---|---|---|---|
| 2,381,048 | A | 8/1945 | Habostad | |
| 2,956,570 | A | 10/1960 | Stanford | |
| 3,353,721 | A * | 11/1967 | Love | 222/209 |
| 3,477,447 | A | 11/1969 | Eldredge | |
| 5,193,557 | A | 3/1993 | Hogan | |
| 5,325,878 | A | 7/1994 | Mc Kay | |
| 5,333,627 | A | 8/1994 | Mehringer et al. | |
| 5,339,839 | A | 8/1994 | Forcelledo et al. | |
| 5,483,979 | A * | 1/1996 | Bertieri | 132/114 |
| 5,555,899 | A | 9/1996 | Foreman | |
| 5,913,314 | A | 6/1999 | Garrett | |
| 5,937,865 | A * | 8/1999 | Dhaliwal | 132/114 |
| 6,035,806 | A | 3/2000 | Lorenzo | |
| 6,053,177 | A * | 4/2000 | Sofer | 132/112 |
| 6,145,513 | A | 11/2000 | Chu et al. | |
| 6,250,312 | B1 * | 6/2001 | Dasilva | 132/208 |
| 6,260,557 | B1 | 7/2001 | Yarbrough | |
| 6,357,450 | B1 * | 3/2002 | Paice | 132/114 |
| 2003/0089743 | A1 * | 5/2003 | Py et al. | 222/386 |

* cited by examiner

*Primary Examiner*—John J. Wilson
*Assistant Examiner*—Robyn Doan

(57) ABSTRACT

A hair root coloring system for applying hair coloring to the roots of the hair of a user. The hair root coloring system includes a dispensing assembly being designed for containing the coloring to be applied to the roots of the hair of user. An application member is coupled to the dispensing assembly whereby the application member is in fluid communication with the dispensing assembly. The dispensing assembly is designed for dispensing the coloring into the application member. The application member is designed for being inserted into the hair of the user to position the application adjacent the roots of the hair of the user whereby the application member is for applying the coloring to the roots of the hair of the user when the dispensing assembly dispenses coloring into the application member.

7 Claims, 6 Drawing Sheets

HAIR ROOT COLORING SYSTEM

BACKGROUND OF THE INVENTION

1. Field of the Invention

The present invention relates to applicators and more particularly pertains to a new hair root coloring system for applying hair coloring to the roots of the hair of a user.

2. Description of the Prior Art

The use of applicators is known in the prior art. U.S. Pat. No. 3,477,447 describes a device for applying hair tinting liquids to hair shows the liquids only being applied at the tips of the distribution elements. Another type of applicator is U.S. Pat. No. 5,333,627 having a device for distributing liquids between bristles for coloring hair. U.S. Pat. No. 5,555,899 has an applicator that has a plurality of fingers, each with an outlet positioned near the tip of associated one of the fingers to apply liquids to the roots of the hair. U.S. Pat. No. 6,260,557 has a hair colorant applicator that has a plurality of teeth with an orifice at the end of each of the teeth to allow fluid to be disbursed from the end of the teeth. U.S. Pat. No. 5,193,557 has an appliance for spraying a hair treatment onto the hair of the user. U.S. Pat. No. 5,325,878 has a comb that dispenses fluid from between the teeth. U.S. Pat. No. 5,339,839 has an applicator with teeth having an open tip for each of teeth to allow for fluid to be applied to the hair of the user. U.S. Pat. No. 5,913,314 has a device with accessory attachments where the liquid is applied to the hair at the base the accessory attachment or the tip of the accessory attachment. U.S. Pat. No. 6,035,806 has a comb with a plurality tines that each have a passage for allowing a liquid to be applied to the hair at the tip of each tine. U.S. Pat. No. 6,145,513 has a applicator for applying hair dye to the hair of a user. U.S. Pat. No. 2,381,048 has an applicator for applying liquids to the hair of the user.

While these devices fulfill their respective, particular objectives and requirements, the need remains for a system that has certain improved features to ensure that hair coloring is applied to all sides of the root of the hair not just leading edge of the hair as is an inherent flaw in the current devices.

SUMMARY OF THE INVENTION

The present invention meets the needs presented above by providing a plurality of application apertures aligned along opposing sides of each of the tines to ensure that coloring is applied around the root of the hair of the user.

Still yet another object of the present invention is to provide a new hair root coloring system that allows the user to maintain a more even coloring of the hair between visits to the salon to get the hair colored.

Even still another object of the present invention is to provide a new hair root coloring system that allows the user easily color the roots of the hair positioned well beyond the hair line of the user.

To this end, the present invention generally comprises a dispensing assembly being designed for containing the coloring to be applied to the roots of the hair of user. An application member is coupled to the dispensing assembly whereby the application member is in fluid communication with the dispensing assembly. The dispensing assembly is designed for dispensing the coloring into the application member. The application member is designed for being inserted into the hair of the user to position the application adjacent the roots of the hair of the user whereby the application member is for applying the coloring to the roots of the hair of the user when the dispensing assembly dispenses coloring into the application member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
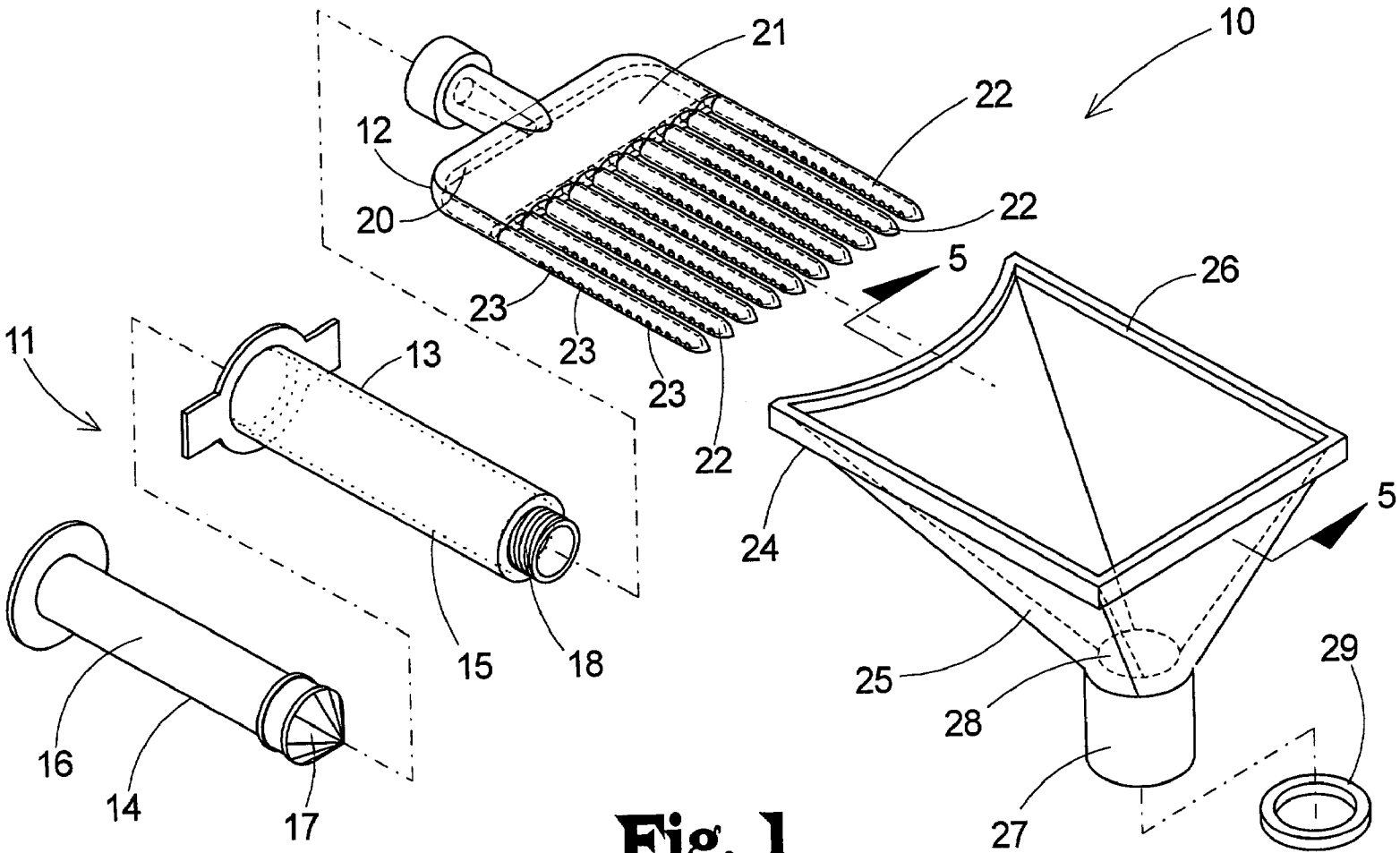
FIG. 1 is an exploded perspective view of a new hair root coloring system according to the present invention.
Figure 2:
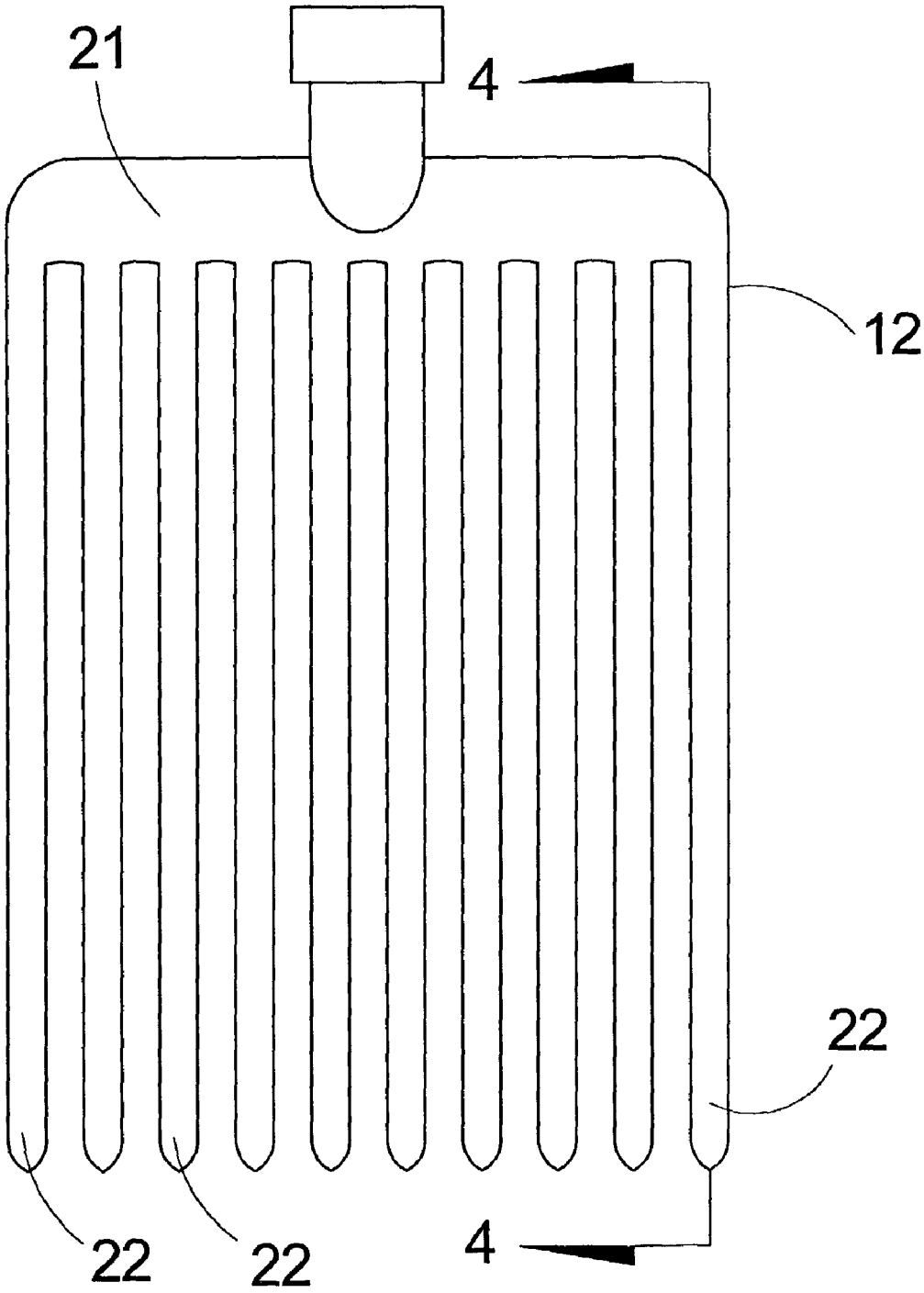
FIG. 2 is a top view of the application member of the present invention.
Figure 3:
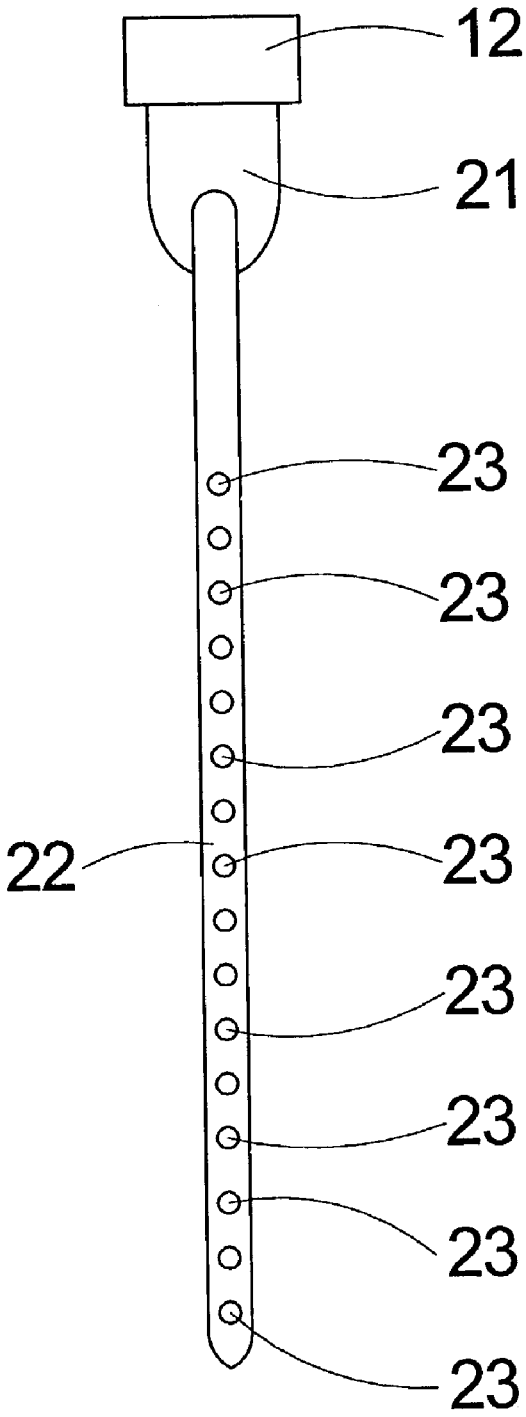
FIG. 3 is a side view of the present invention.
Figure 4:
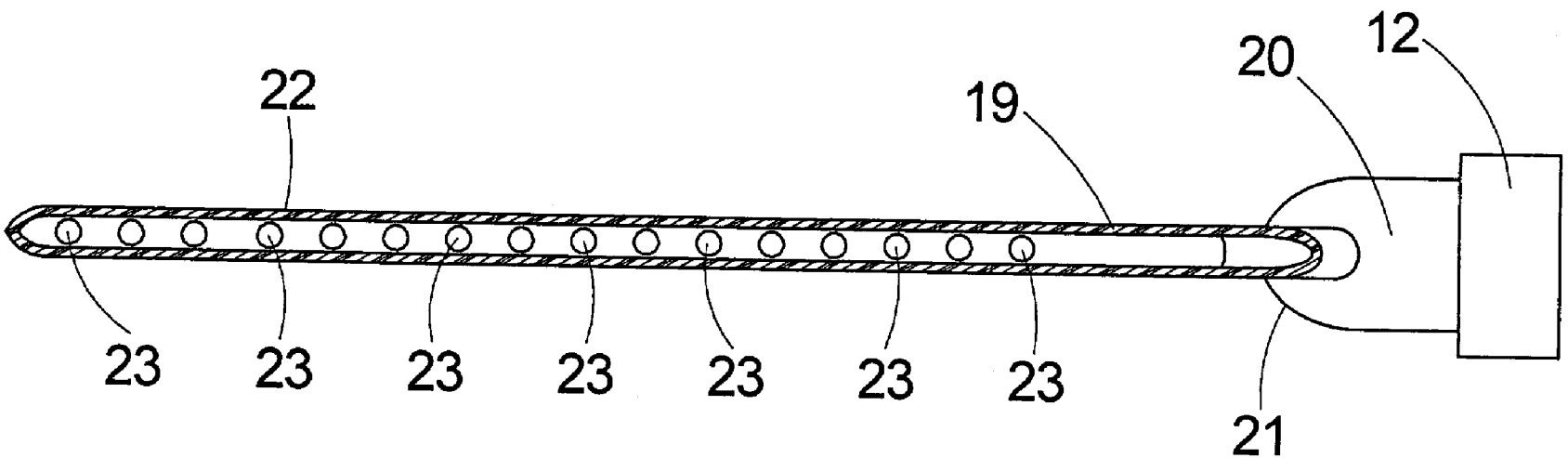
FIG. 4 is a cross-sectional view of the present invention taken along the line 4—4 of FIG. 2.
Figure 5:
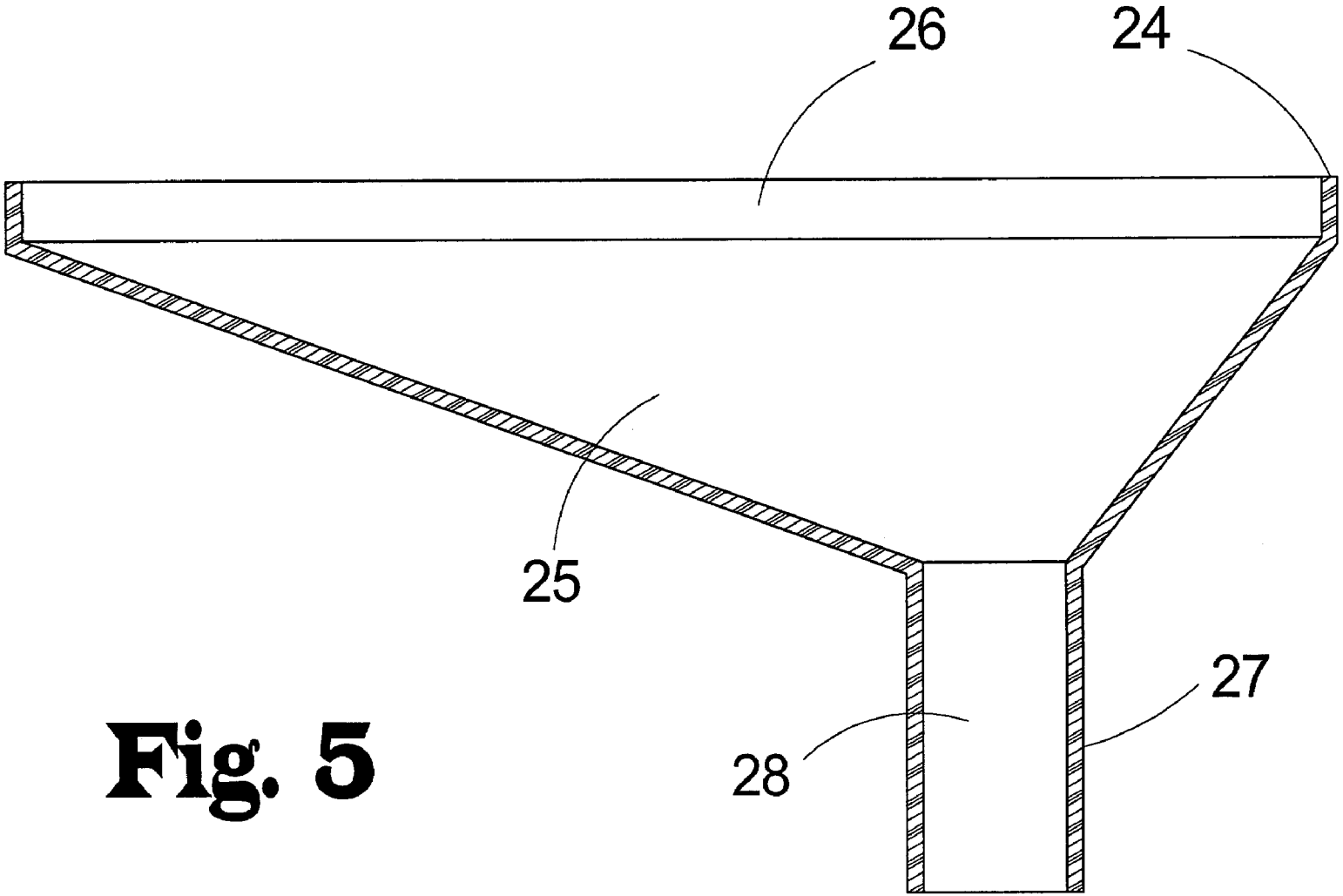
FIG. 5 is a cross-sectional view of the present invention taken along line 5—5 of FIG. 1.
Figure 6:
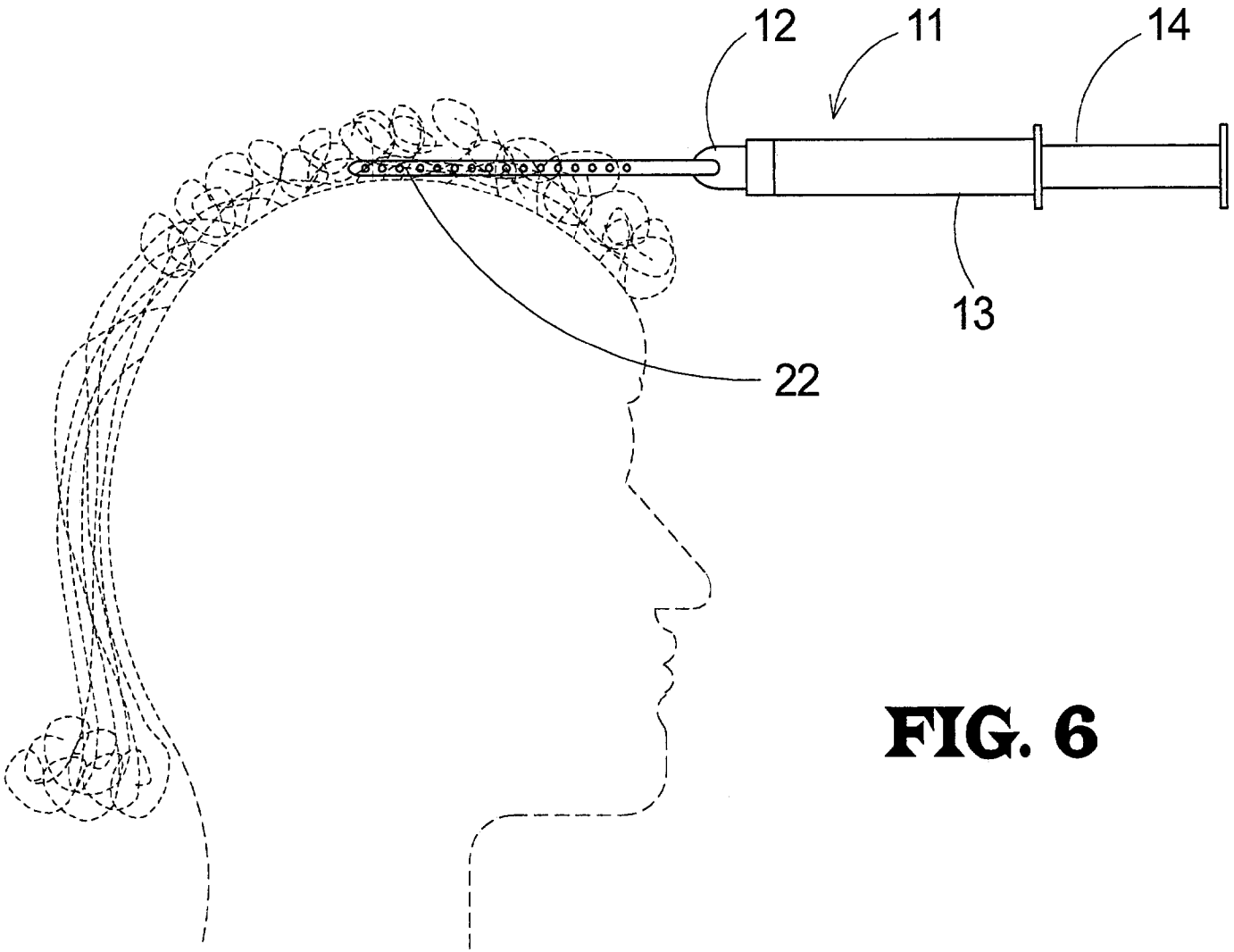
FIG. 6 is a side view of the dispensing assembly and the application member of the present invention shown in use.

With reference now to the drawings, and in particular to FIGS. 1 through 6 thereof, a new hair root coloring system embodying the principles and concepts of the present invention and generally designated by the reference numeral 10 will be described.

As best illustrated in FIGS. 1 through 6, the hair root coloring system 10 generally comprises a dispensing assembly 11 being designed for containing the coloring to be applied to the roots of the hair of user.

An application member 12 is coupled to the dispensing assembly 11 whereby the application member 12 is in fluid communication with the dispensing assembly 11. The dispensing assembly 11 is designed for dispensing the coloring into the application member 12. The application member 12 is designed for being inserted into the hair of the user to position the application adjacent the roots of the hair of the user whereby the application member 12 is for applying the coloring to the roots of the hair of the user when the dispensing assembly 11 dispenses coloring into the application member 12. The Application member 12 has a length of about 3¾ inches and a width of about 3 inches.

The dispensing assembly 11 comprises a sleeve member 13 and a plunger member 14. The plunger member 14 is selectively inserted into a lumen 15 of the sleeve member 13. The lumen 15 of the sleeve member 13 is in fluid communication with the application member 12. The lumen 15 of the sleeve member 13 is designed for receiving the coloring whereby the plunger member 14 is for forcing the coloring from the lumen 15 of the sleeve member 13 into the application member 12 when the plunger member 14 is inserted into the lumen 15 of the sleeve member 13 and slid along a length of the sleeve member 13.

The plunger member 14 comprises a shaft portion 16 and a tip portion 17. The tip portion 17 is coupled to the shaft portion 16 whereby the tip portion 17 engages the sleeve member 13 when the plunger member 14 is inserted into the lumen 15 of the sleeve member 13. The tip portion 17 of the plunger member 14 is designed for inhibiting the coloring from passing between the tip portion 17 and the sleeve member 13 when the plunger member 14 is inserted into the lumen 15 of the sleeve member 13. The shaft portion 16 is designed for being engaged by a hand of the user to force the tip portion 17 along the length of the sleeve member 13.

The tip portion 17 of the plunger portion comprises a flexible material, such as rubber. The flexible material forms a seal between the tip portion 17 and the sleeve member 13 whereby the flexible material is designed for inhibiting passage of the coloring between the tip portion 17 of the plunger member 14 and the sleeve member 13.

The sleeve member 13 comprises a connector end 18. The connector end 18 is positioned opposite the plunger member 14 when the plunger member 14 is inserted into the lumen 15 of the sleeve member 13. The connector end 18 threadably engages the application member 12 whereby the connector end 18 permits the sleeve member 13 to be separated from the application member 12.

The application member 12 comprises a perimeter wall 19. The perimeter wall 19 of the application member 12 defines an interior space 20 of the application member 12. The interior space 20 of the application member 12 is in fluid communication with the lumen 15 of the sleeve member 13 of the dispensing assembly 11 when the application member 12 is coupled to the connector end 18 of the sleeve member 13 of the dispensing assembly 11. The interior space 20 of the application member 42 is designed for receiving the coloring from the delivery assembly.

The application member 12 comprises a base portion 21. The base portion 21 of the application member 12 is threadably coupled to the connector end 18 of the sleeve member 13 of the dispensing assembly 11 for permitting fluid communication between the interior space 20 of the application member 12 and the lumen 15 of the sleeve member 13 of the dispensing assembly 11.

The application member 12 comprises a plurality of tines 22. Each of the tines 22 extends outwardly from the base portion 21 of the application assembly whereby the tines 22 are positioned opposite the dispensing assembly 11 when the application member 12 is coupled to the dispensing assembly 11. Each of the tines 22 is designed for extending between the roots of the hair of the user when the application member 12 is inserted into the hair of the user. Each of the tines 22 comprises a plurality of application apertures 23 extending through the perimeter wall 19 of the application member 12 whereby each of the application apertures 23 is in fluid communication with the interior space 20 of the application member 12. Each of the application apertures 23 of each of the tines 22 is designed for dispensing the coloring onto the roots of the hair of the user to color the roots of the hair of the user. Each of the application apertures 23 of each of the tines 22 is aligned along opposing sides of the associated one of the tines 22 whereby the application apertures 23 are designed for directly contacting the roots of the hair of the user for applying the coloring directly to the root of the hair of the user when the coloring is dispensed from the dispensing assembly 11.

A pan member 24 selectively receives the application member 12. The pan member 24 is designed for collecting coloring dripping from the application apertures 23 of the tines 22 of the application member 12 when the application member 12 is removed from the hair of the user and received by the pan member 24.

The pan member 24 comprises a bottom portion 25 and a barrier portion 26. The barrier portion 26 extends upwardly from the bottom portion 25 whereby the barrier portion 26 is positioned around the application member 12 when the pan member 24 receives the application member 12. The bottom portion 25 supports the application member 12 when the pan member 24 receives the application member 12. The barrier portion 26 is designed for inhibiting the coloring from spilling from the pan member 24 when the coloring drips from the application member 12.

The pan member 24 comprises a neck portion 27. The neck portion 27 is coupled to the bottom portion 25. The bottom portion 25 is sloped towards the neck portion 27 whereby the bottom portion 25 is designed for funneling the coloring to the neck portion 27. The neck portion 27 comprises a bore 28 extending through the neck portion 27 whereby the neck portion 27 selectively engages the dispensing assembly 11. The bore 28 of the neck portion 27 is fluid communication with the lumen 15 of the sleeve member 13 of the dispensing assembly 11 whereby the bore 28 is designed for transferring the coloring to the dispensing assembly 11 when the neck portion 27 is engaged to the dispensing assembly 11.

A cap member 29 is selectively coupled to the neck portion 27 of the pan member 24 opposite the bottom portion 25 of the pan member 24. The cap member 29 seals the bore 28 whereby the cap member 29 is designed for inhibiting leaking of the coloring from the bore 28 of the neck portion 27 when the neck portion 27 is disengaged from the dispensing assembly 11.

In use, the user couples the sleeve member 13 to the application member 12. Coloring for hair is then poured into the lumen 15 of the sleeve member 13. The tip portion 17 of the plunger member 14 is inserted into the lumen 15 of the sleeve member 13 to prevent the coloring from leaking out of the sleeve member 13. The tines 22 of the application member 12 are inserted into the hair so that the tines 22 are positioned along the scalp and the roots of the hair and all of the application apertures 23 are positioned past the hair line of the user. The plunger member 14 is then pushed into the lumen 15 of said sleeve member 13 to force the coloring into the interior space 20 of the application member 12 and through the application holes in each of the tines 22. The application member 12 is then moved side to side to ensure that the roots around the tines 22 are thoroughly coated with the coloring. When the application member 12 is removed from the hair the application member 12 is positioned on the bottom portion 25 of the pan member 24. As the coloring drips from the application apertures 23 in the application member 12 onto the bottom portion 25 the coloring is funneled into the bore 28 of the neck portion 27 of the pan member 24. The user can then removed the cap member 29 and allow the coloring in the bore 28 of the neck portion 27 of the pan member 24 to flow into the lumen 15 of the sleeve member 13 to allow the unused coloring to be captured and reused. The applying of the coloring is continued to until all of the roots have been colored to maintain an even appearance to the coloring of the hair after the hair has grown after the initial coloring.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair root coloring system for applying coloring to the roots of the hair of a user, the hair root coloring system comprising:

a dispensing assembly being adapted for containing the coloring to be applied to the roots of the hair of user;

an application member being coupled to said dispensing assembly such that said application member is in fluid communication with said dispensing assembly, said dispensing assembly being adapted for dispensing the coloring into said application member, said application member being adapted for being inserted into the hair of the user to position said application adjacent the roots of the hair of the user such that said application member is for applying the coloring to the roots of the hair of the user when said dispensing assembly dispenses coloring into said application member;

said dispensing assembly comprising a sleeve member and a plunger member, said plunger member being selectively inserted into a lumen of said sleeve member, said lumen of said sleeve member being in fluid communication with said application member, said lumen of said sleeve member being adapted for receiving the coloring such that said plunger member is for forcing the coloring from said lumen of said sleeve member into said application member when said plunger member is inserted into said lumen of said sleeve member and slid along a length of said sleeve member;

said plunger member comprising a shaft portion and a tip portion, said tip portion being coupled to said shaft portion such that said tip portion engages said sleeve member when said plunger member is inserted into said lumen of said sleeve member, said tip portion of said plunger member being adapted for inhibiting the coloring from passing between said tip portion and said sleeve member when said plunger member is inserted into said lumen of said sleeve member, said shaft portion being adapted for being engaged by a hand of the user to force said tip portion along the length of said sleeve member;

said tip portion of said plunger portion comprising a flexible material, said flexible material forming a seal between said tip portion and said sleeve member such that said flexible material is adapted for inhibiting passage of the coloring between said tip portion of said plunger member and said sleeve member;

said sleeve member comprising a connector end, said connector end being positioned opposite said plunger member when said plunger member is inserted into said lumen of said sleeve member, said connector end threadably engaging said application member such that said connector end permits said sleeve member to be separated from said application member;

said application member comprising a perimeter wall, said perimeter wall of said application member defining an interior space of said application member, said interior space of said application member being in fluid communication with said lumen of said sleeve member of said dispensing assembly when said application member is coupled to said connector end of said sleeve member of said dispensing assembly, said interior space of said application member being adapted for receiving the coloring from said delivery assembly;

said application member comprising a base portion, said base portion of said application member being threadably coupled to said connector end of said sleeve member of said dispensing assembly for permitting fluid communication between said interior space of said application member and said lumen of said sleeve member of said dispensing assembly;

said application member comprising a plurality of tines, each of said tines extending outwardly from said base portion of said application assembly such that said tines are positioned opposite said dispensing assembly when said application member is coupled to said dispensing assembly, each of said tines being adapted for extending between the roots of the hair of the user when said application member is inserted into the hair of the user, each of said tines comprising a plurality of application apertures extending through said perimeter wall of said application member such that each of said application apertures is in fluid communication with said interior space of said application member, each of said application apertures of each of said tines being adapted for dispensing the coloring onto the roots of the hair of the user to color the roots of the hair of the user;

each of said application apertures of each of said tines being aligned along opposing sides of the associated one of said tines such that said application apertures are adapted for directly contacting the roots of the hair of the user for applying the coloring directly to the root of the hair of the user when the coloring is dispensed from said dispensing assembly;

a pan member selectively receiving said application member, said pan member being adapted for collecting coloring dripping from said application apertures of said tines of said application member when said application member is removed from the hair of the user and received by said pan member;

said pan member comprising a bottom portion and a barrier portion, said barrier portion extending upwardly from said bottom portion such that said barrier portion is positioned around said application member when said pan member receives said application member, said bottom portion supporting said application member when said pan member receives said application member, said barrier portion being adapted for inhibiting the coloring from spilling from said pan member when the coloring drips from said application member;

said pan member comprising a neck portion, said neck portion being coupled to said bottom portion, said said bottom portion being sloped towards said neck portion such that said bottom portion is adapted for funneling the coloring to said neck portion, said neck portion comprising a bore extending through said neck portion such that said neck portion selectively engages said dispensing assembly, said bore of said neck portion being fluid communication with said lumen of said sleeve member of said dispensing assembly such that said bore is adapted for transferring the coloring to said dispensing assembly when said neck portion is engaged to said dispensing assembly; and a cap member being selectively coupled to said neck portion of said pan member opposite said bottom portion of said pan member, said cap member sealing said bore such that said cap member is adapted for inhibiting leaking of the coloring from said bore of said neck portion when said neck portion is disengaged from said dispensing assembly.

2. A hair root coloring system for applying coloring to the roots of the hair of a user, the hair root coloring system comprising:

a dispensing assembly being adapted for containing the coloring to be applied to the roots of the hair of user;

an application member being coupled to said dispensing assembly such that said application member is in fluid communication with said dispensing assembly, said dispensing assembly being adapted for dispensing the coloring into said application member, said application member being adapted for being inserted into the hair of the user to position said application adjacent the roots of the hair of the user such that said application member is for applying the coloring to the roots of the hair of the user when said dispensing assembly dispenses coloring into said application member;

a pan member selectively receiving said application member, said pan member being adapted for collecting coloring dripping from said application member when said application member is removed from the hair of the user and received by said pan member;

said pan member comprising a bottom portion and a barrier portion, said barrier portion extending upwardly from said bottom portion such that said barrier portion is positioned around said application member when said pan member receives said application member, said bottom portion supporting said application member when said pan member receives said application member, said barrier portion being adapted for inhibiting the coloring from spilling from said pan member when the coloring drips from said application member; and said pan member comprising a neck portion, said neck portion being coupled to said bottom portion, said said bottom portion being sloped towards said neck portion such that said bottom portion is adapted for funneling the coloring to said neck portion, said neck portion comprising a bore extending into said neck portion such that said neck portion selectively engages said dispensing assembly, said bore of said neck portion being fluid communication with said dispensing assembly such that said bore is adapted for transferring the coloring to said dispensing assembly when said neck portion is engaged to said dispensing assembly.

3. The hair root coloring system as set forth in claim 2, comprising:

said application member comprising a perimeter wall, said perimeter wall of said application member defining an interior space of said application member, said interior space of said application member being in fluid communication with said dispensing assembly when said application member is coupled to said dispensing assembly, said interior space of said application member being adapted for receiving the coloring from said delivery assembly.

4. The hair root coloring system as set forth in claim 3, comprising:

said application member comprising a base portion, said base portion of said application member being threadably coupled to said dispensing assembly for permitting fluid communication between said interior space of said application member and said dispensing assembly.

5. The hair root coloring system as set forth in claim 4, comprising:

said application member comprising a plurality of tines, each of said tines extending outwardly from said base portion of said application assembly such that said tines are positioned opposite said dispensing assembly when said application member is coupled to said dispensing assembly, each of said tines being adapted for extending between the roots of the hair of the user when said application member is inserted into the hair of the user, each of said tines comprising a plurality of application apertures extending through said perimeter wall of said application member such that each of said application apertures is in fluid communication with said interior space of said application member, each of said application apertures of each of said tines being adapted for dispensing the coloring onto the roots of the hair of the user to color the roots of the hair of the user.

6. The hair root coloring system as set forth in claim 5, comprising:

each of said application apertures of each of said tines being aligned along opposing sides of the associated one of said tines such that said application apertures are adapted for directly contacting the roots of the hair of the user for applying the coloring directly to the root of the hair of the user when the coloring is dispensed from said dispensing assembly.

7. The hair root coloring system as set forth in claim 2, comprising:

a cap member being selectively coupled to said neck portion of said pan member opposite said bottom portion of said pan member, said cap member sealing said bore such that said cap member is adapted for inhibiting leaking of the coloring from said bore of said neck portion when said neck portion is disengaged from said dispensing assembly.

* * * * *